US005596162A

United States Patent [19]

Burns

[11] Patent Number: 5,596,162

[45] Date of Patent: Jan. 21, 1997

[54] FIREARM SELECTABLE BETWEEN SEMI-AUTOMATIC AND AUTOMATIC MODE

[76] Inventor: Robert L. Burns, 117 Lake Shore Dr., Pasadena, Md. 21122

[21] Appl. No.: 333,786

[22] Filed: Nov. 3, 1994

Related U.S. Application Data

[63] Continuation-in-part of Ser. No. 911,903, Jul. 10, 1992, abandoned.

[51] Int. Cl.[6] ..... F41A 19/46

[52] U.S. Cl. ..... 89/128; 84/142

[58] Field of Search ..... 42/69.03, 70.08; 89/128, 140, 141, 142

[56] References Cited

U.S. PATENT DOCUMENTS 3,964,368 6/1976 Safie ..... 89/141
4,306,487 12/1981 Beretta ..... 42/70.08
5,267,407 12/1993 Bornancini ..... 42/70.08

FOREIGN PATENT DOCUMENTS 3111037 10/1982 Germany ..... 42/69.03
241574 4/1926 United Kingdom ..... 89/142

OTHER PUBLICATIONS

Jane's Infantry Weapons 1984–1985, pp. 43–47.
Beretta 92F Series Armorer's Handbook.

*Primary Examiner*—Stephen C. Bentley
*Attorney, Agent, or Firm*—Max Stul Oppenheimer

[57] ABSTRACT

A pistol is disclosed which is selectable between automatic and semi-automatic operation. A device is provided which permits existing semiautomatic firearms to be converted so that they may be fired in either fully automatic or semiautomatic mode. A novel trigger bar and selector are disclosed.

9 Claims, 4 Drawing Sheets

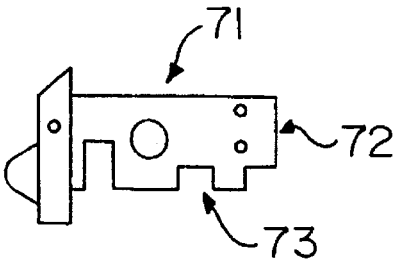
FIG. 3(a)
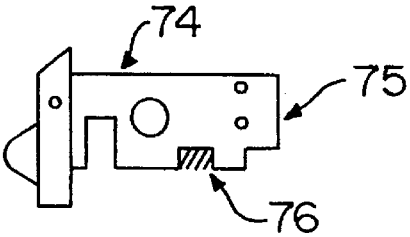
FIG. 3(b)
FIG. 4(a)
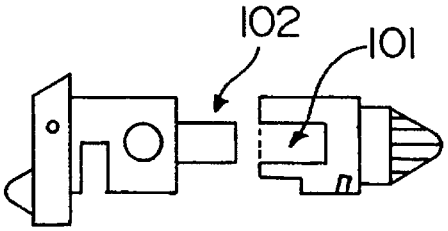
FIG. 4(b)
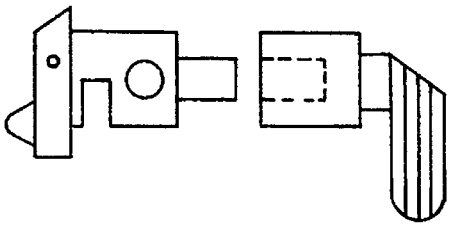

FIREARM SELECTABLE BETWEEN SEMI-AUTOMATIC AND AUTOMATIC MODE

This application is a continuation-in-part of U.S. Ser. No. 07/911,903, filed Jul. 10,1992 abandoned.

FIELD AND BACKGROUND OF THE INVENTION

The present invention relates in general to firearms and in particular to a new and useful device which permits firing in either automatic or semi-automatic mode.

Firearms are known which include a fire selector which has three positions: (1) safety, which prevents firing; (2) semi-automatic, which permits firing of a single round each time the trigger is depressed; and (3) automatic, which permits firing for as long as the trigger is held.

U.S. Pat. No. 5,267,407 ("Safety Device for Semiautomatic Pistol"), issued Dec. 7, 1993 to Bornancini, discloses a three-position safety register, although the three positions do not include a fully automatic position. The Bornancini device is designed to select among locked, decocked and firing positions; it does not enable automatic mode operation of a semi-automatic pistol.

Prior art devices for permitting selection among modes exist, but involve complicated apparatus. Particularly in automatic mode, complication translates into risk of failure, such as jamming of the firearm. An example is provided in U.S. Patent No. 3,964,368 ("Automatic Pistol"), issued Jun. 22, 1976 to Safie. Safie permits operation in a semi-automatic or automatic (referred to in Safie as "burst firing") mode, by providing a selector lever (referred to in Safie as the stop selector member) which can be rotated to engage a shoulder on a trigger bar so as to engage a disconnector with a chamfered and bent end to maintain the disconnector out of engagement with a sear in order to permit burst firing, or rotated so as not to engage said shoulder, thereby allowing the disconnector to prevent firing of a second round until the trigger is released (semi-automatic more). Safie thus requires the manufacture of a pistol incorporating numerous special-purpose parts, and engineering to accomodate those parts.

It is therefore an object of the invention to provide a firearm which can be fired in either automatic or semi-automatic mode, with reduced risk of jamming or other failure of the firearm and therefore greater reliability and reduced need for service.

It is a further object of the invention to provide a mechanism for allowing a firearm to be selectively set to either an automatic or semi-automatic mode at low cost and low level of complexity.

It is a further object of the invention to provide a mechanism for allowing a firearm to be converted from semi-automatic to selectable semi-automatic or automatic at a low cost and with high reliability and low level of complexity.

The various features of novelty which characterize the invention are pointed out with particularity in the claims annexed to and forming a part of this disclosure. For a better understanding of the invention, its advantages and objects, reference is made to the accompanying drawings and descriptive matter in which a preferred embodiment of the invention is illustrated.

BRIEF DESCRIPTION OF THE DRAWINGS

FIG. 3 is a side view showing a conventional selection (FIG. 3A) and a selector in accordance with the invention (FIG. 3B).

FIG. 4 shows side views of an alternative embodiment of the novel selector with the additional feature that it permits selection between semi-automatic and fully automatic modes.

DESCRIPTION OF THE PREFERRED EMBODIMENT

Figure 5:
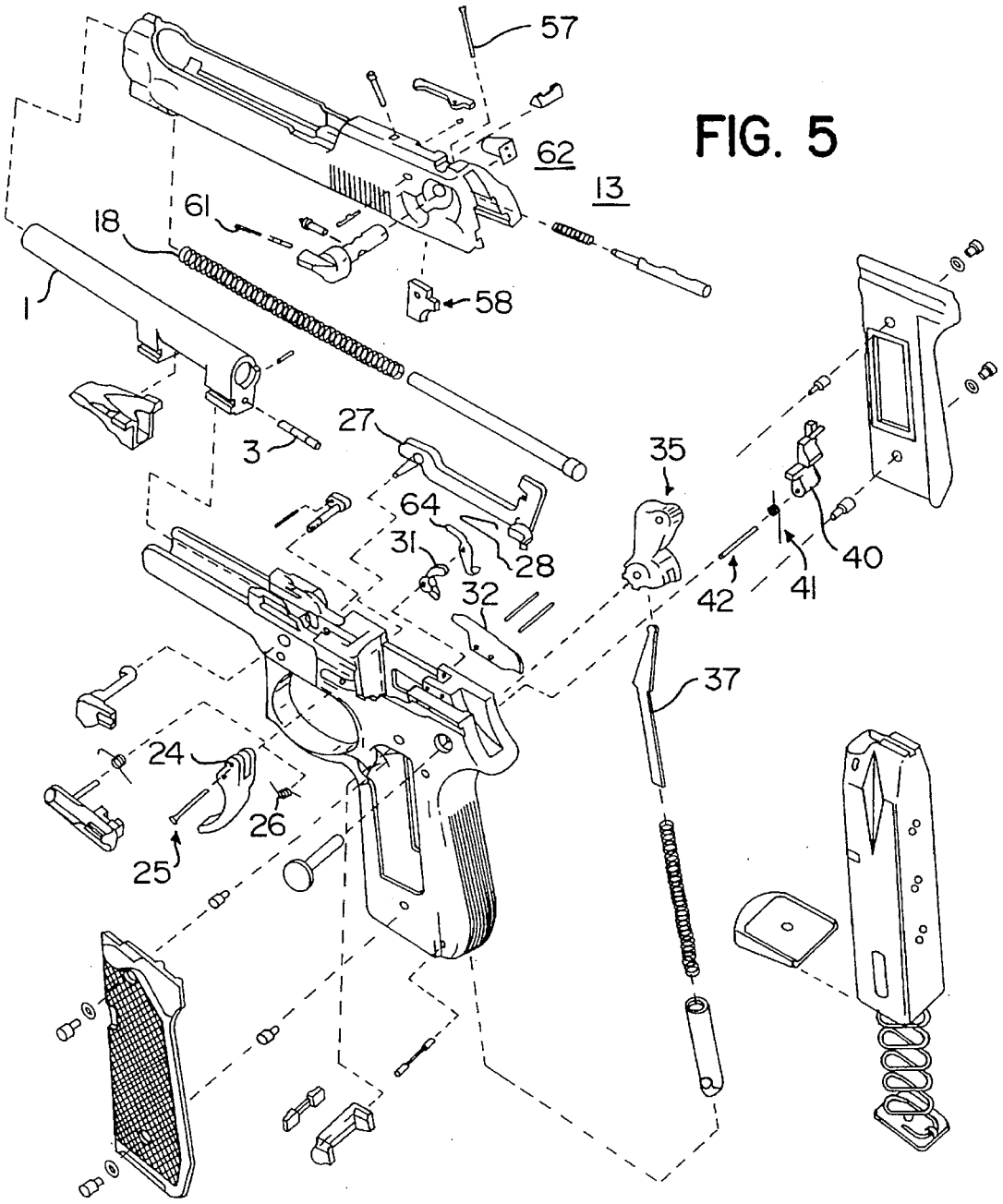
FIG. 5 is an exploded view of a BERETTA (TM) semi-automatic pistol, Model 92F.

Referring to the drawings, the invention embodied in the drawings is a firearm which includes a receiver FIG. 5, 1) having a chamber for cartridges in a magazine (FIG. 5, 52) attached to a lower housing (2) connected to the receiver (1). A trigger (24) is pivotally mounted to the lower housing (2). The trigger (24) is held in a relaxed position by a trigger spring (FIG. 5, 26) which holds the trigger (24) against a first stop.

A sear (FIG. 5, 40) is rotatably mounted to the housing (2) about a sear pin (FIG. 5, 42) and is held in position by a sear spring (FIG. 5, 41).

When the trigger (24) is pulled, it activates a trigger bar (27) causing a hammer (35) to strike the first end of a firing pin assembly which extends axially between the hammer (35) and a cartridge to be fired. The firing pin assembly comprises a a firing pin (15) and a firing pin spring (FIG. 5, 13).

The impact of the firing pin (15) on the cartridge causes explosives contained in the cartridge to ignite, and the resulting expanding gases cause the bullet to be forced forward through the barrel and the slide (5) to recoil.

Trigger bar (27) includes a disconnector arm (28) formed with a cutout (29) in the front of the trigger bar's disconnector arm (28). After discharge, a hook on a firing pin catch lever (64) engages the release notch (29) and prevents repeat firing until the trigger (24) has been released.

A fire selector (which may also serve as a safety lever or decocking lever) (FIG. 5, 14) has a handle which is external of the housing for permitting rotation of the fire selector (14).

Figure 1:
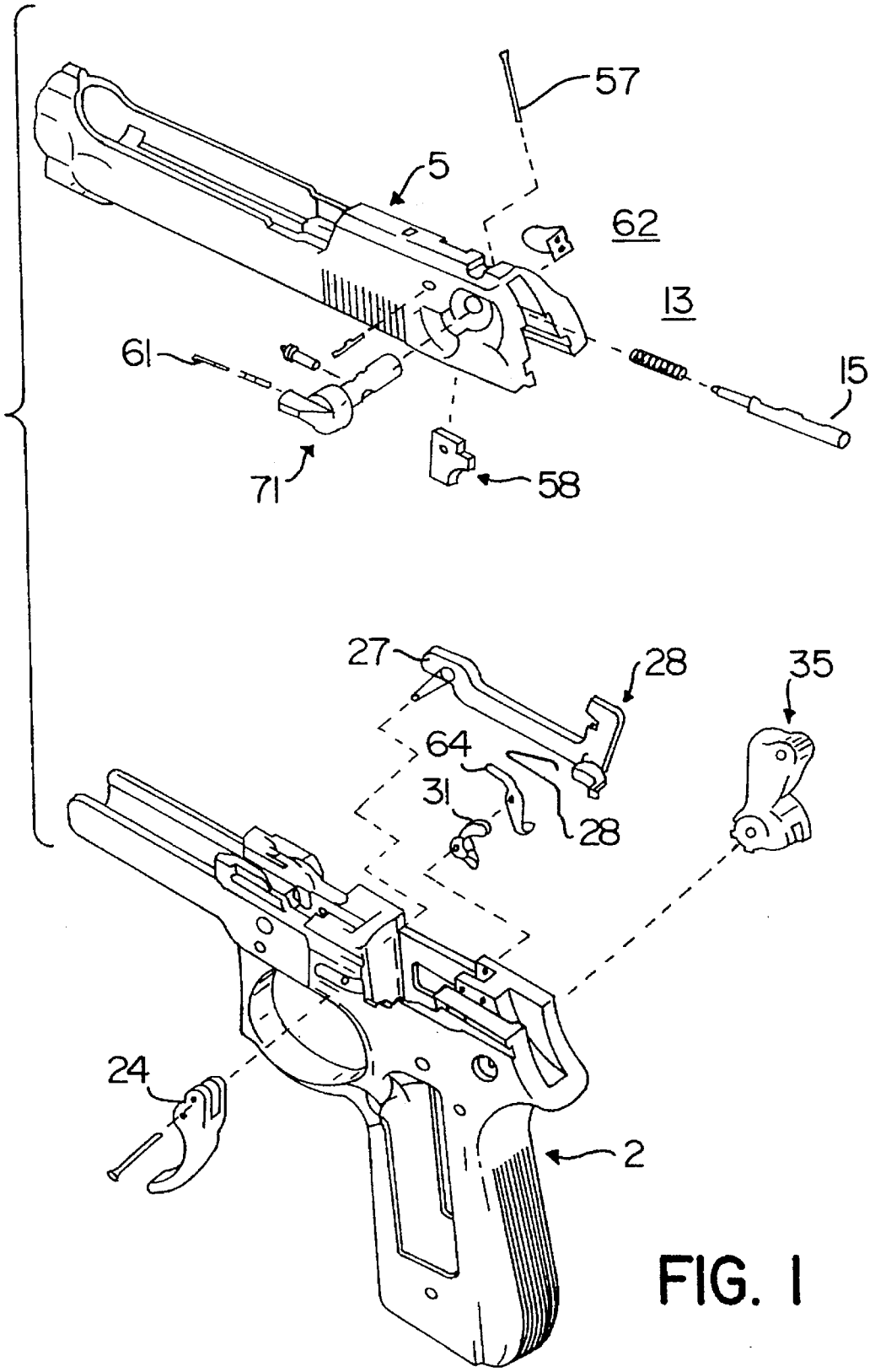
FIG. 1 is an exploded view of a firearm, illustrating the main parts necessary for an understanding of the invention.
Figure 2A:
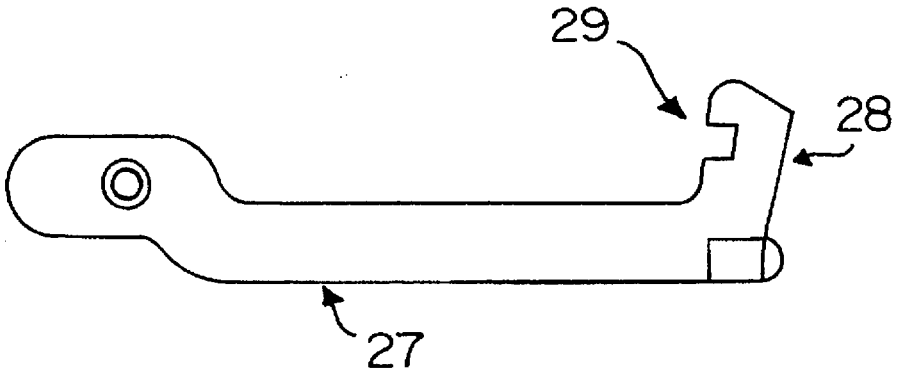
FIG. 2 is a side view showing a conventional trigger bar (FIG. 2 (*a*) and a trigger bar in accordance with the invention (FIG. 2 (*b*)
Figure 2B:
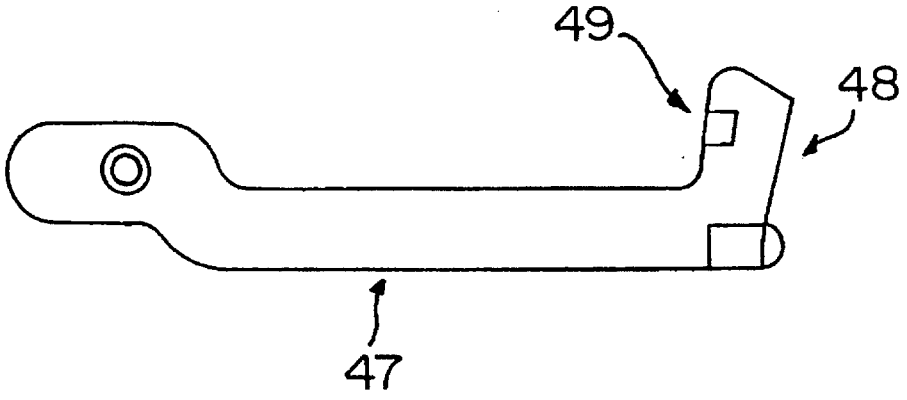

With the foregoing structure of the invention explained, reference is now made to FIGS. 2 through 4 which illustrates in detail the present invention.

The invention comprises a pistol having semi-automatic and fully automatic modes of operation. The pistol comprises a frame (2), a trigger (24) carried by said frame (2) and a slide (5) removably mounted to said frame (2), a trigger bar (27) operated by said trigger (24) and engaged to a firing mechanism, said trigger bar (27) having a disconnector arm (28) and the firing mechanism having a hammer (35) for striking a firing pin (15) and a firing pin catch lever (64) disposed so that it would engage a notch in said disconnector arm (28), were one present, after firing of said pistol, thereby preventing further firing of said pistol while said firing pin catch would be engaged with said notch. The disconnector arm (28), however, presents an essentially straight surface to said firing pin catch as shown by area (49) in FIG. 2*b*, thereby preventing engagement with said firing pin catch. The pistol further comprises a decocking lever for lowering said hammer (35) and a hammer release lever (31) mounted to said frame, said selector lever having a first position in which said selector lever engages said decocking lever so as to lower said hammer, allowing the pistol to fire repeatedly as fast the recoil causes the slide (5) to cock the hammer for as long as said trigger is held pulled, and a second position in which said selector lever engages said decocking lever so as to decock the firearm, then releases said decocking lever (thereby preventing further firing until the trigger is released). This second position functions as does the conventional safety decocking lever in a BERETTA (TM) 92F, for example.

FIG. 2 compares a conventional trigger bar from a BERETTA (TM) Model 92F (FIG. 2(*a*)), with a trigger bar manufactured in accordance with the invention (FIG. 2(*b*)). Note that the conventional trigger bar (27) comprises a disconnection arm (28) which is characterized by release notch (29); the invention teaches a modified trigger bar (47) with a release arm (48) but with a straight edge (49) in place of release notch (29).

Likewise, FIG. 3 compares a conventional decoding lever (11) (also know as a safety lever) from a BERETTA (TM) Model 92F (FIG. 3A) with a safety lever manufactured in accordance with the invention (FIG. 3B). Note that the conventional safety lever (71) comprises an essentially partially cylindrical portion (72) into which a notch or flat edge (73) has been formed, while the novel device modified selector (74) comprises an essentially completely cylindrical portion (75) such as would be formed if flat edge (73) were filled to the diameter of the cylindrical portion as shown in (76). In this configuration, a single lever acts both as a safety lever and as a lever activating the fully automatic mode; thus, the firearm may fire in fully automatic mode only.

The invention is implemented by providing a fire selector lever having a first position and a second position, and a trigger bar which presents an essentially straight edge along the trigger bar's disconnector arm. When the fire selector lever is moved to the second position, the modified trigger bar prevents the firing pin catch lever from disengaging with the firing pin catch assembly thus permitting the firearm to operate in the fully automatic mode and to continue firing for as long as the trigger is pulled. In this mode, the modified selector engages the hammer release lever as the slide comes to full battery. It should be noted that all firing from the automatic mode must be done from double action since the hammer release lever is positively engaged.

As shown in FIG. 4, the selector may, instead, be separate from the safety lever, thereby allowing the user to select between fully automatic and semi-automatic mode. As illustrated, the selector is composed of two mating pieces, which provides for greater structural strength than would two completely separate levers.

The firing sequence in automatic mode takes place as follows. As the operator fires the first shot from the double action mode a chambered cartridge is fired. As the slide starts its rearward travel the modified trigger bar (47) prevents a firing pin catch (58) from disengaging thus eliminating the necessity for another trigger pull. As the spent cartridge is extracted the slide (5) stops its rearward progress and under force of a recoil spring (18) starts its forward movement. At this point another cartridge is recovered from the magazine and loaded into the chamber area of the barrel. As the slide (5) comes to battery, the modified selector (74) engages the hammer release lever (31) and the hammer (35) is released to strike the new cartridge.

Experimental Results

The invention has been implemented by modifying a BERETTA (TM) semi-automatic pistol (Model 92F), a widely available device which has been adopted as a NATO standard sidearm, as described below.

The invention is applicable to all BERETTA (TM) Model 92 handguns which include BERETTA (TM) Models 92F Compact, 92FM, 92F Stainless, 92G, 96F, 96G, 92DS, and to similar firearms.

The unmodified operation of the BERETTA (TM) 92F Series handguns is described in detail in "92F Series Armorers Handbook", which is incorporated herein by reference. Attention is particularly directed to Section A, "Model 92SB-F Description and Functioning". A brief summary of the unmodified operation follows.

Referring to FIG. 5, when the trigger (24) is pulled it rotates around trigger pin (25). The trigger's upper forearm moves forward pulling the trigger bar (27) forward while compressing the trigger spring (26). The trigger bar's rear pull lug is engaged to the hammer's double-action notch. As the notch is pulled the hammer (35) rotates around the hammer pin (36). As the trigger bar (27) moves forward it cocks the hammer. When the front of the trigger bar's disconnector arm reaches the hook on the lower arm of the firing pin catch (64) lever it rotates the lever around its pin. As the catch rotates, its upper arm lifts the firing pin catch (also know as a firing pin block) (58) and simultaneously compresses the firing pin catch out of engagement, and the firing pin advances.

As the trigger bar's pull lug reaches a cross bar on the sear (40) and pushes the sear forward the sear rotates on the sear pin (42) and the sear nose clears the hammer hub simultaneously compressing the sear's spring (41). When the trigger bar (27) disconnects from the hammer (35), the compressed hammer spring pushes hammer spring guide (37) upward and its strut head swings the hammer toward the striker in rotation around the hammer pin.

When the hammer strikes the firing pin plunger the firing pin is thrown forward against the cartridge primer, discharging the cartridge. High pressure gases push the bullet through the bore and the slide into recoil motion. As the trigger pull is completed the trigger bar (27) spring lifts the trigger bar's disconnector arm into a slide rail disconnector cam slide. When the slide recoils, a release cut-out into the front surface of the trigger bar's disconnector arm (28) corresponds to a hook on the firing pin catch's lower arm. The firing pin catch spring can now drop the firing pin catch (64) into a firing pin slot locking forward firing pin advancement. The firing pin catch pushes down the upward forward pointing arm of the firing pin catch lever and rotates the lever clockwise around its pin swinging its lower hook arm into the trigger bar disconnector arm's release cut-out.

At this point the firing pin, firing pin block and firing pin catch lever are all returned to their original positions.

According to the manufacturer, from the moment of discharge to reloading and ready for repeated fire, the cycle rate of the 92F firearm is about 1,100 rounds per minute.

The BERETTA (TM) Model 92F firearm was modified in accordance with the invention as follows. The trigger bar (27) was modified by filling the release lever notch (29). The hammer release lever notch (73) of the selector was also filled approximately to the diameter. A suitable technique for filling is to use heliarc welding, then machine the weld to a thickness, diameter and smoothness consistent with the remainder of the component so filled; alternatively, new components could be fabricated without the notches. This converted the BERETTA (TM) 92F firearm to a fully automatic pistol. Subsequently, the modified selector was replaced by a selector divided into two parts, each freely rotatable as shown in FIG. 4. This allowed the BERETTA (TM) 92F firearm to be fired in either the automatic or semi-automatic mode by rotating the right half of the selector lever while retaining the safety function of the left half of the selector lever. In a preferred embodiment, the two parts are connected by providing a cylindrical opening (101) in one part along the axis, and providing in the second part a cylindrical shape (102) slightly smaller than the opening, thereby allowing each part to rotate independently while maintaining structural strength.

The result was a firearm in which a fire selector lever is movably mounted to the receiver, disposed to select a semi-automatic fire position. When the automatic fire position is selected, the selector is disposed to engage firing pin catch lever (64), firing pin catch spring (57) and firing pin catch (58) and hammer release lever (31). When the semi-automatic mode is selected, the hammer release lever (31) is not engaged and the hammer release mechanism operates as described above. The trigger bar is shaped so as to engage the firing pin catch lever mechanism (64), in the specific case of the BERETTA (TM) 92F firearm this is done simply by filling the notch in said mechanism as shown on FIG. 2.

Selection between automatic or semi-automatic mode is accomplished as follows. With reference to right hand selector lever (62) with said selector lever in the upright position the BERETTA (TM) 92F firearm functions (as it originally did) in the semi-automatic mode. When said selector lever (62) is moved to the down position, the modified trigger bar (47) prevents the firing pin catch lever (64) from disengaging with the firing pin catch assembly thus permitting the firearm to operate in the fully automatic mode and to continue firing for as long as the trigger is pulled. In this mode, the modified selector lever (62) engages the hammer release lever (31) as the slide comes to full battery. It should be noted that all firing from the automatic mode must be done from double action since the hammer release lever is positively engaged.

The firing sequence in automatic mode takes place as follows. As the operator fires the first shot from the double action mode the chambered cartridge is fired. As the slide (5) starts its rearward travel the modified trigger bar (47) prevents the firing pin catch (58) from disengaging thus eliminating the necessity for another trigger pull. As the spent cartridge is extracted the slide stops its rearward progress and under force of the recoil spring starts its forward movement. At this point another cartridge is recovered from the magazine and loaded into the chamber area of the barrel. As the slide comes to battery, the modified selector (74) engages the hammer release lever (31) and the hammer is released to strike the new cartridge.

In experimental firings, a cycle rate of approximately 700 to 750 rounds per minute was observed. This firing rate is an advantage over higher rates because it allows better control of the firearm.

As can be seen from the above description, it is possible to implement the invention simply and easily either by replacing the selector lever and trigger bar of a BERETTA (TM) 92F firearm with parts meeting the specifications described above, or converting a BERETTA (TM) 92F firearm by modifying the selector lever and trigger bar supplied by BERETTA (TM) simply by filling the original hammer release lever notch of the selector, and filling the notch in the original trigger bar.

While a specific embodiment of the invention has been shown and described in detail to illustrate the application of the principles of the invention may be embodied otherwise without departing from such principles and that various modifications, alternate constructions, and equivalents will occur to those skilled in the art given the benefit of this disclosure. Thus, the invention is not limited to the specific embodiment described herein, but is defined by the appended claims.

What is claimed is:

1. A pistol having semi-automatic and fully automatic modes of operation, comprising:

a frame;

a slide removably mounted to said frame;

a trigger carried by said frame;

a trigger bar operated by said trigger and engaged to a firing mechanism, said trigger bar having a disconnector arm;

said firing mechanism having a hammer for striking a firing pin and a firing pin catch having a hook disposed so that it contacts said disconnector arm, after firing of said pistol, said disconnector arm presenting an essentially straight surface to said firing pin catch hook thereby preventing engagement with said firing pin catch;

a decocking lever for lowering said hammer; and a selector lever mounted to said slide, said selector lever having a first position in which said selector lever engages said decocking lever so as to lower said hammer, allowing the pistol to fire repeatedly as fast the recoil causes the slide to cock the hammer for as long as said trigger is held pulled.

2. A pistol as in claim 1 wherein said selector lever comprises a substantially cylindrical portion for engagement with said decocking lever.

3. A method for producing a pistol as in claim 1 by converting a BERETTA (TM) Type 92 firearm having a trigger bar, said trigger bar having a release arm and said disconnector arm having a cutout; said BERETTA (TM) Type 92 firearm having a safety lever, said safety lever having a cylindrical portion, said cylindrical portion having a flat face; to permit user selection of automatic or semi-automatic firing, comprising the steps of: providing an unmodified BERETTA (TM) Type 92 firearm and filling the trigger bar release arm cutout of said firearm to approximately the thickness of said trigger bar release arm.

4. A method for producing a pistol as in claim 3, further comprising the step of filling the flat face of said cylindrical portion of said selector lever to approximately the diameter of said cylindrical portion.

5. A method for producing a pistol as in claim 1 by converting a BERETTA (TM) Type 92 firearm having a trigger bar, said trigger bar having a release arm and said release arm having a cutout; said BERETTA (TM) Type 92 firearm having a selector lever, said selector lever having a cylindrical portion, said cylindrical portion having a flat face; to permit user selection of automatic or semi-automatic firing, comprising the steps of: providing an unmodified BERETTA (TM) Type 92 firearm and filling the flat face of said cylindrical portion of said selector lever to approximately the diameter of said cylindrical portion.

6. A method for producing a pistol having semi-automatic and fully automatic modes of operation, comprising the steps of:

providing a firearm having a frame; a slide removably mounted to said frame; a trigger carried by said frame; a trigger bar operated by said trigger and engaged to a firing mechanism, said trigger bar having a disconnector arm and said disconnector arm having a cutout; said firing mechanism having a hammer for striking a firing pin and a firing pin catch having a hook disposed so that it contacts said disconnector arm after firing of said firearm; a decocking lever for lowering said hammer; and a selector lever mounted to said slide, said selector lever having a cylindrical portion and said cylindrical portion having a flat face; and filling the cutout to approximately the thickness of said disconnector arm.

7. A method as in claim 6 further comprising the step of filling the flat face to approximately the diameter of the cylindrical portion.

8. A method as in claim 7 wherein said firearm is selected from among the BERETTA (TM) 92 Series of firearms.

9. A method as in claim 8 wherein said firearm is selected from among the BERETTA (TM) 92F Series of firearms.

* * * * *